US005417594A

United States Patent [19]

Herman et al.

[11] Patent Number: 5,417,594

[45] Date of Patent: * May 23, 1995

[54] MALE ELECTRICAL PLUG ASSEMBLY WITH INCREASED ELECTRICAL CREEPAGE DISTANCE BETWEEN CONTACTS

[75] Inventors: Wallace U. Herman, Fairfield; Patrick J. Tiberio, Huntington, both of Conn.

[73] Assignee: Hubbell Incorporated, Orange, Conn.

[ * ] Notice: The portion of the term of this patent subsequent to Aug. 9, 2011 has been disclaimed.

[21] Appl. No.: 206,163

[22] Filed: Mar. 7, 1994

[51] Int. Cl.[6] ..... H01R 13/502

[52] U.S. Cl. ..... 439/690; 439/332; 439/673

[58] Field of Search ..... 439/332, 335, 659, 686, 439/690–695, 701, 725, 727, 810–814, 337

[56] References Cited

U.S. PATENT DOCUMENTS

| | | | |
|---|---|---|---|
| 1,630,166 | 5/1927 | Catlin et al. | 439/691 X |
| 3,525,068 | 8/1970 | Nelson | 439/332 |
| 4,003,618 | 1/1977 | Booty | 439/332 X |
| 4,199,207 | 4/1980 | Lee | 439/690 X |
| 4,255,007 | 3/1981 | Michaels et al. | 439/332 |
| 4,738,628 | 4/1988 | Rees | 439/332 X |
| 5,234,355 | 8/1993 | Sosinski et al. | 439/337 |

*Primary Examiner*—Neil Abrams
*Assistant Examiner*—Hien D. Vu
*Attorney, Agent, or Firm*—Jerry M. Presson; Michael R. Swartz

[57] ABSTRACT

A male electrical plug assembly includes an elongated body, terminal holder and terminal retainer made of an insulating material. The body has locating elements and locating passages aligned with the locating elements. The terminal holder fits over an opposite end portion of the body and has cavities formed thereon and slots defined therein aligned with the cavities. The cavities and slots are alignable with the locating passages and the locating elements. The male plug assembly also includes electrical terminals disposed in the cavities and elongated electrical contact elements mounted to the locating elements and extending through the locating passages of the body and through the slots and through the cavities of the terminal holder and through the terminals disposed in the cavities and into the terminal retainer.

20 Claims, 9 Drawing Sheets

MALE ELECTRICAL PLUG ASSEMBLY WITH INCREASED ELECTRICAL CREEPAGE DISTANCE BETWEEN CONTACTS

CROSS-REFERENCE TO RELATED APPLICATION

Reference is hereby made to the following application containing subject matter related to that of the subject application and assigned to the same assignee as the subject application: "Male Electrical Plug Assembly With Increased Electrical Creepage Distance Between Contacts" by William C. Boteler, assigned U.S. Ser. No. 08/102,918 and filed Aug. 6, 1993, which issued into U.S. Pat. No. 5,336,116 on Aug. 9, 1994.

BACKGROUND OF THE INVENTION

1. Field of the Invention

The present invention generally relates to electrical couplers and, more particularly, is concerned with an improved male electrical plug assembly with increased electrical creepage distance between contacts.

2. Description of the Prior Art

Locking electrical couplers having male plugs and female connectors which first mate and then rotate relative to one another have been commercially available for many years for application in numerous industrial and special uses. These electrical couplers have generally incorporated 3 to 5 electrical contacts and have been rated at 20, 30, 50 and 60 Amps and from 125 VAC to 250 VAC and to 600 VAC.

Traditionally, the interior current-carrying portion of the male plugs of these electrical couplers were manufactured by insert molding of forged or sintered electrical contacts, having swaged or wrought terminal shanks, into a thermoset insulating body. This traditional construction has both important advantages and disadvantages. The advantages are that the integrally molded assembly is resistant to both axial and rotational forces on the electrical contacts and that electrical creepage distances are limited only by the established configuration. Creepage distance refers to the shortest distance along the surface of insulating material between two conductive parts.

The disadvantages are that the thermoset molding cycle is extremely slow and the molds are susceptible to damage due to misplaced contact inserts. Also, insert molding requires the assistance of an operator. Further, post-molding machining is necessary to remove overmolded insulating material from the working surfaces of the contacts and to assure the tolerances required by the configuration for the diameters of these working surfaces. Furthermore, the thermosetting materials available have limited impact strength. The molding cycle time and the impact strength could be addressed by insert molding with a thermoplastic material, but the cost of the molds at risk from misplaced inserts would be much greater and the configuration would require section thicknesses which could not be molded in thermoplastic without excessive shrinking, sinking, voids and dimensional discrepancies.

Attempts have been made to replace the traditional insert molded/thermoset construction with an alternative constructional approach involving post molding assembly of electrical contacts and thermoplastic insulating parts. However, this alternative approach does not retain the inherent resistance of the traditional construction to axial forces on the contacts. Instead, the alternative approach relies on a small threaded fastener to resist separation due to tensile forces. Also, the minimum electrical creepage distance provided under the alternative approach is not commensurate with the 600 VAC rating of the electrical coupling device. The measured electrical creepage distance of one commercial device employing this alternative approach is only approximately 5.5 mm, whereas established international standards provide for electrical creepage distances ranging from 8 to 10 mm, depending upon the respective materials used.

Consequently, a need still exists for improvement in the construction of the male plugs for locking electrical couplers. The type of improvement desired is one which will retain the advantages of the traditional construction approach for male plugs while eliminating the disadvantages thereof but without introducing new disadvantages in the place of the old ones being eliminated.

SUMMARY OF THE INVENTION

The present invention provides a male electrical plug assembly designed to satisfy the aforementioned needs. The male electrical plug assembly of the present invention permits the achievement of increased electrical creepage distance between the electrical contacts of the plug. For example, the electrical creepage distances are at no point less than the established 10 mm requirement for the 30 Amp plug configuration. The male plug assembly of the present invention also provides features for permitting assembly and disassembly of the parts thereof without the use of an external fixture as in the case of the male plug assembly of the invention disclosed and claimed in the patent application cross-referenced above.

Accordingly, the present invention is directed to a male electrical plug assembly which comprises: (a) an elongated body of insulating material including one end portion, an opposite end portion and a middle flange portion integrally connected with and disposed between the one end portion and opposite end portion and extending radially outwardly therefrom, the elongated body having a plurality of locating elements defined on the one end portion of the body being circumferentially spaced and separate from one another and a plurality of locating passages defined through the middle flange portion of the body being aligned with the locking elements; (b) a terminal holder of insulating material adapted to fit over the opposite end portion of the elongated body and having an inner face adapted to abut against an inner face of the middle flange portion thereof, the terminal holder also having a plurality of cavities formed thereon and a plurality of slots defined therein aligned with the cavities and extending between the cavities and the inner face of the terminal holder, the cavities and slots being alignable with the locating passages of the middle flange portion and the locating elements of the one end portion of the elongated body; (c) a terminal retainer of insulating material attachable to the opposite end portion of the elongated body so as to clamp the terminal holder between the terminal retainer and the middle flange portion of the elongated body; (d) a plurality of electrical terminals disposed in the cavities of the terminal holder; and (e) a plurality of elongated electrical contact elements mountable to the locating elements on the one end portion of the elongated body and extendable therefrom through the locating passages of the middle flange portion of the elongated body and through the slots and through the cavities of the terminal holder and through the electrical terminals disposed in the cavities of the terminal holder and into the terminal retainer.

The male plug assembly also includes first interengaging means for interengaging the inner face of the middle flange portion of the elongated body with the inner face of the terminal holder so as to resist rotation of the terminal holder relative to the middle flange portion of the elongated body and to provide a predetermined electrical creepage distance between the electrical contacts at an interface formed between the inner face of the terminal holder and the inner face of the middle flange portion of the elongated body. The male plug assembly further includes second interengaging means for interengaging the terminal holder with the terminal retainer so as to resist rotation of the terminal retainer relative to the terminal holder and to provide a predetermined electrical creepage distance.

These and other features and advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
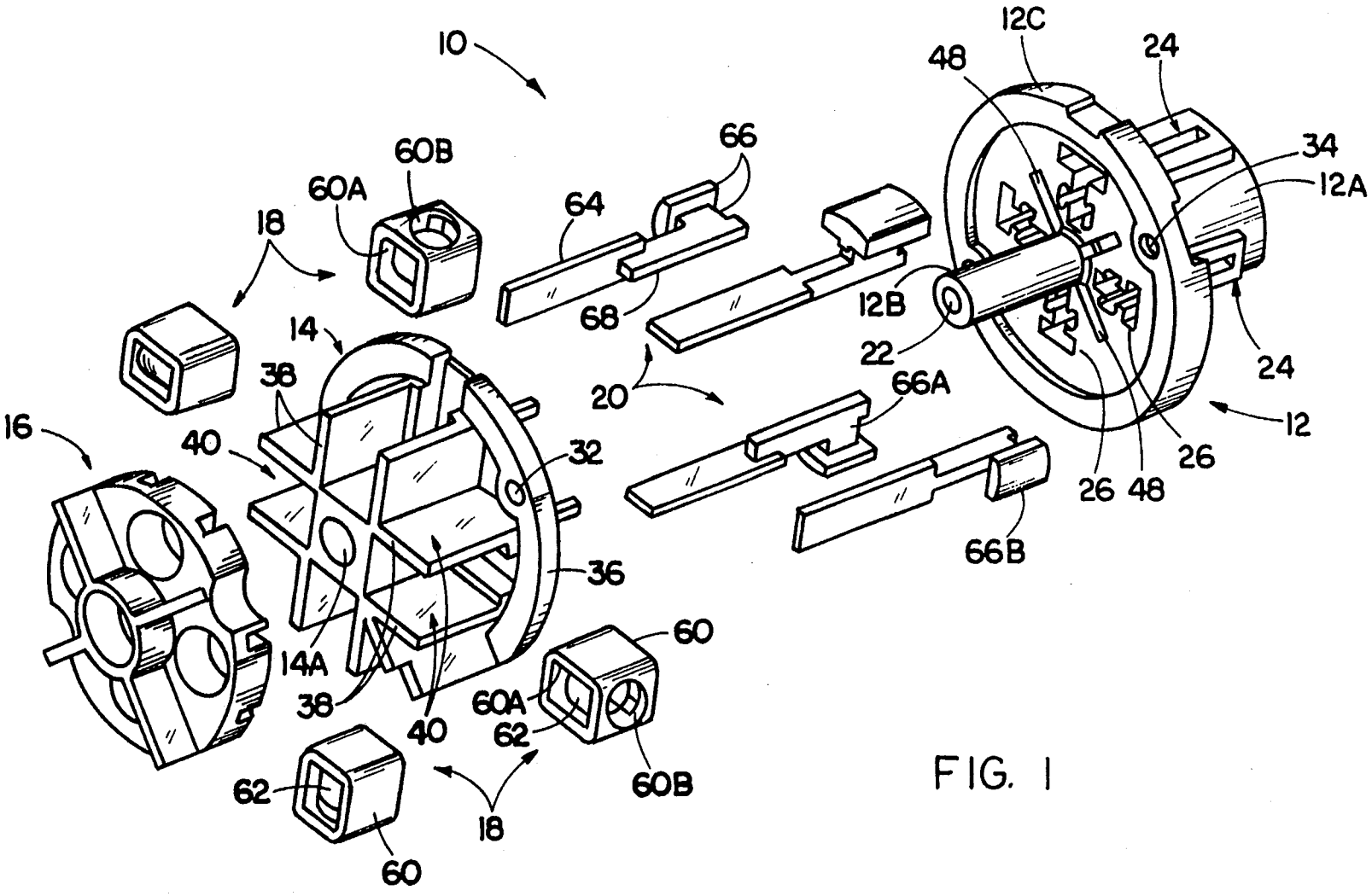
FIG. 1 is an exploded perspective view of an improved male electrical plug assembly in accordance with the present invention.

In the following description, like reference characters designate like or corresponding parts throughout the several views. Also in the following description, it is to be understood that such terms as "forward", "rearward", "left", "right","upwardly", "downwardly", and the like, are words of convenience and are not to be construed as limiting terms.

Figure 2:
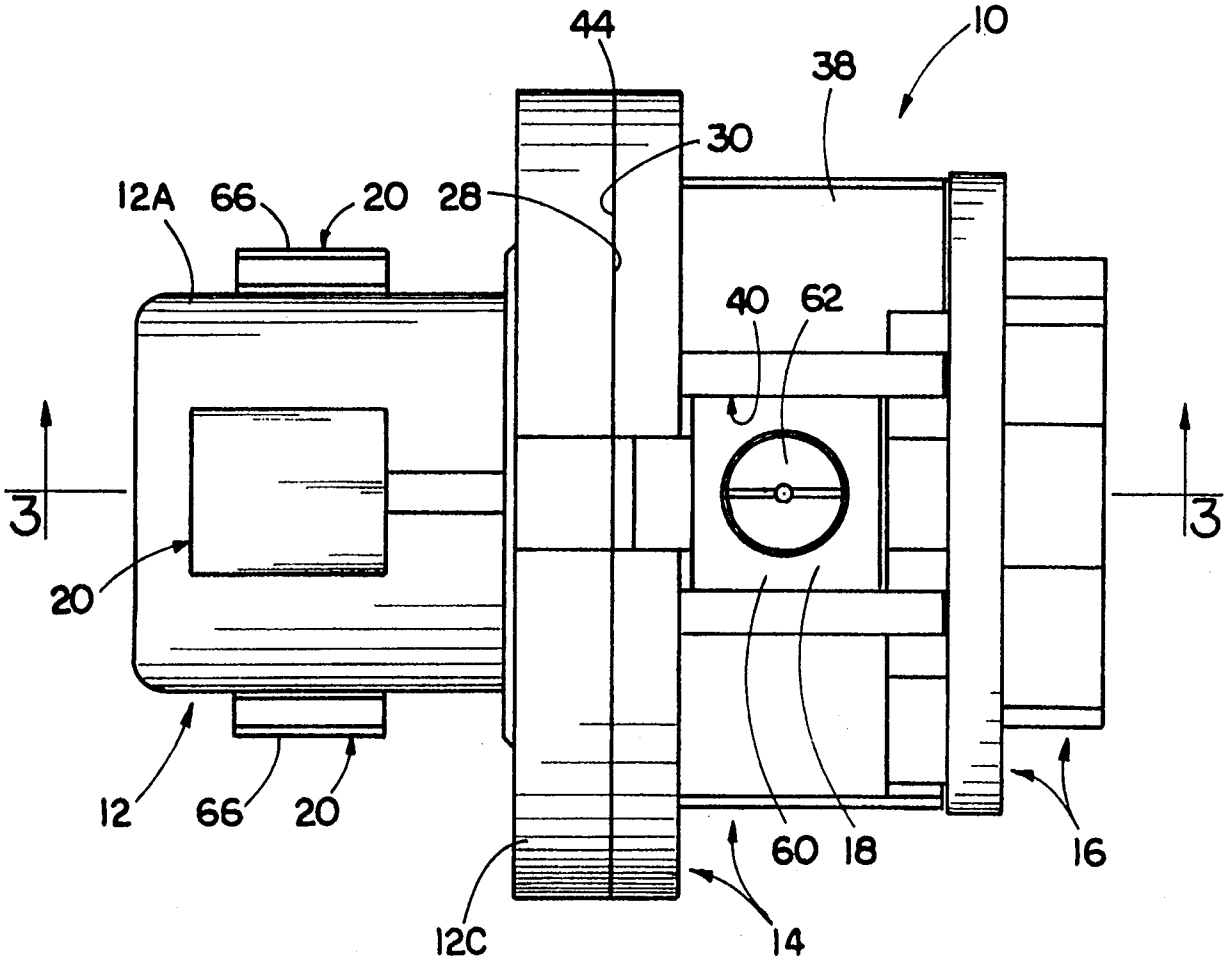
FIG. 2 is an enlarged side elevational view of the assembled male plug assembly.
Figure 3:
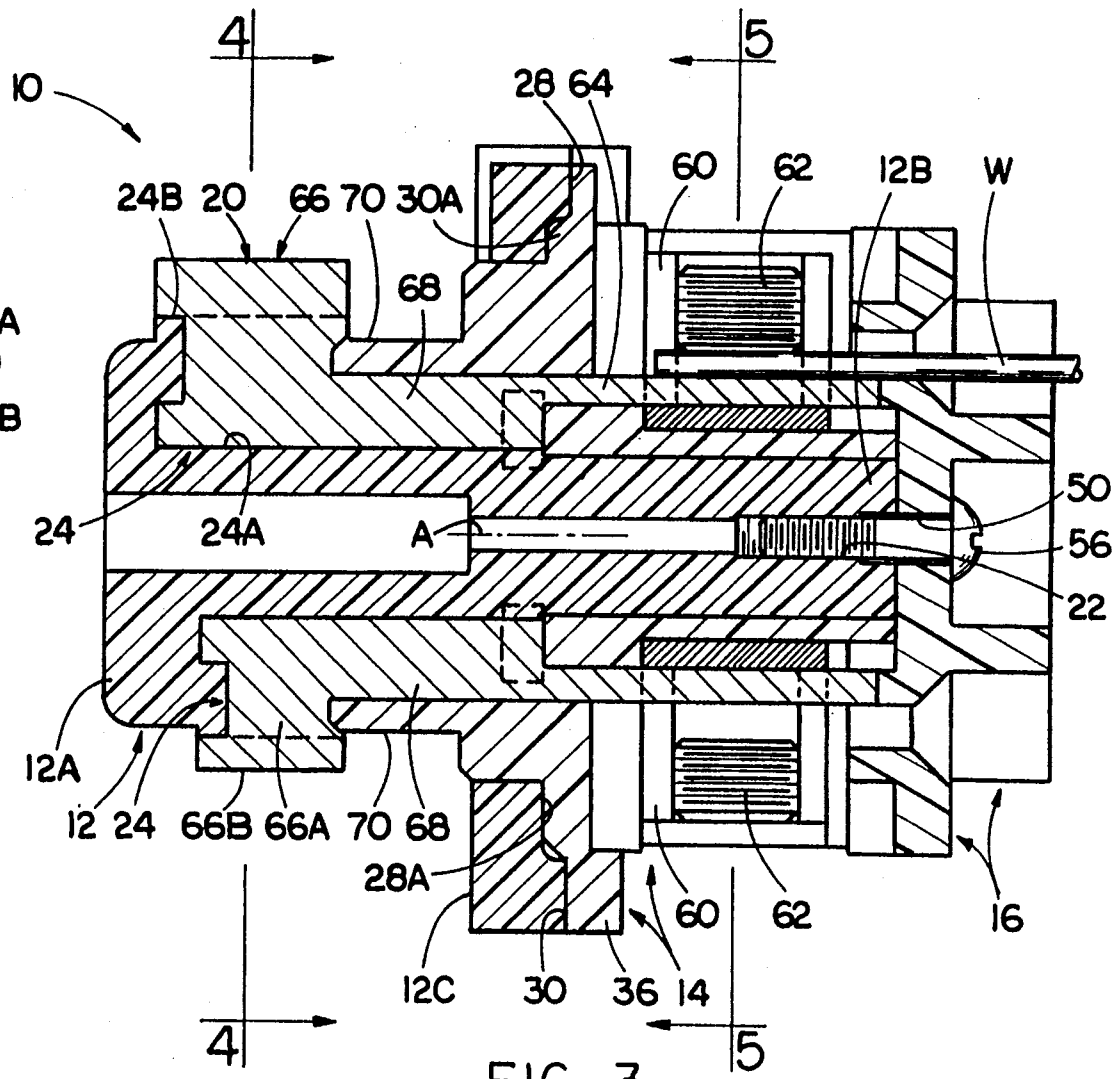
FIG. 3 is an enlarged longitudinal sectional view of the assembly taken along line 3—3 of FIG. 2.

Referring now to the drawings, and particularly to FIGS. 1–3, there is illustrated an improved male electrical plug assembly of the present invention, generally designated 10. The male plug assembly 10 basically includes an elongated body 12, a terminal holder 14 and a terminal retainer 16, all of which are made of a suitable insulating material. One suitable material is an impact resistant thermoplastic having a comparative tracking index of greater than 175 volts. The male plug assembly 10 also includes a plurality of electrical terminals 18 and a plurality of elongated electrical contact elements 20.

More particularly, referring to FIGS. 1–4 and 6–10, the elongated body 12 of the assembly 10 includes one end portion 12A, an opposite end portion 12B and a middle flange portion 12C disposed between the one end portion 12A and the opposite end portion 12B and extending radially outwardly therefrom. More particularly, the middle flange portion 12C of the body 12 is axially aligned and integrally connected in series with its one end portion 12A and opposite end portion 12B. Also, the middle flange portion 12C of the body 12 is larger in diameter than its one end portion 12A and opposite end portion 12B, whereas the one end portion 12A of the body 12 is larger in diameter than its opposite end portion 12B. Further, the opposite end portion 12B of the body 12 has a central opening 22 defined therein which is illustrated as being internally-threaded.

Figure 4:
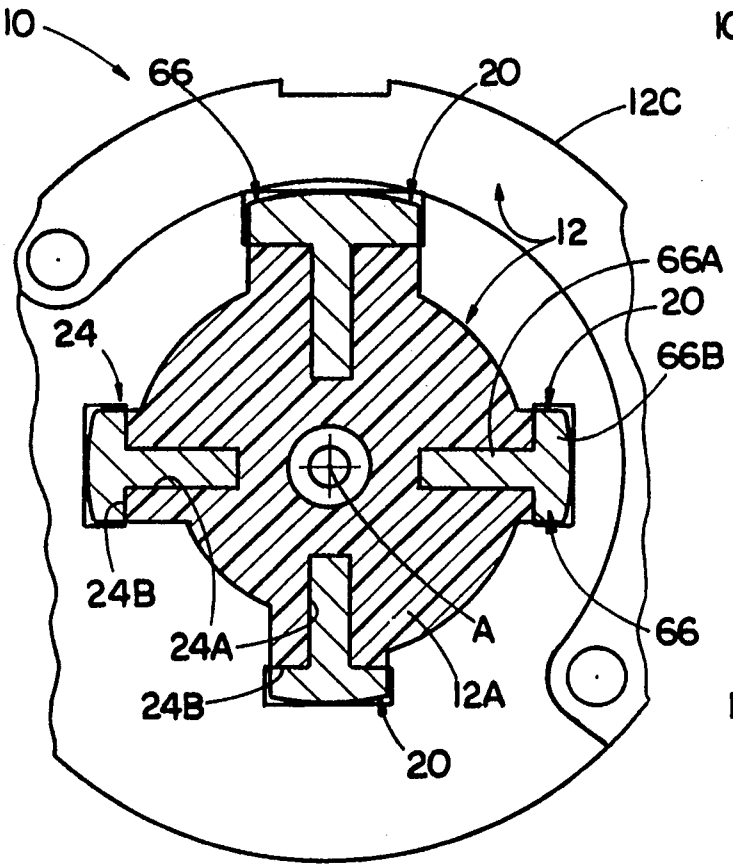
FIG. 4 is a cross-sectional view of the assembly taken along line 4—4 of FIG. 3.

Also, as best seen in FIGS. 1, 3, 4 and 8–11, the elongated body 12 of the assembly 10 includes a plurality of locating elements 24 defined on the one end portion 12A of the body 12 which are circumferentially spaced and separate from one another and a plurality of locating passages 26 defined through the middle flange portion 12C of the body 12 which are separate and circumferentially spaced from one another. The locating passages 26 are aligned with the locating elements 24. Each of the locating elements 24 includes a channel 24A defined in the one end portion 12A of the body 12 and a flat land 24B defined on the exterior surface of the one end portion 12A of the body 12 extending along opposite sides of the top edges of the channel 24A. As best seen in FIGS. 3 and 4, lengthwise the channels 24A extend substantially parallel to one another and to a central axis A of the elongated body 12 and thus of the assembly 10, whereas depthwise the channels 24A extend generally radially relative to the central axis A. On the other hand, the flat lands 24B extend substantially perpendicular to respective radial lines R extending from the central axis A and depthwise through the channels 24A. As will be explained hereinafter, the locating elements 24 and locating passages 26 of the elongated body 12 mount respective portions of the contact elements 20.

Referring to FIGS. 1–3, 5, 6 and 11–13, the terminal holder 14 of the assembly 10 has an overall annular configuration and a central bore 14A adapting it to fit over the opposite end portion 12B of the elongated body 12 in abutting relationship against the middle flange portion 12C thereof. More particularly, the middle flange portion 12C of the body 12 has an overall annular configuration of a diameter matching that of the terminal holder 14 such that they can be positioned flush against one another in the abutting relationship. The middle flange portion 12C of the body 12 has an inner face 28 with a centrally recessed region 28A therein whereas the terminal holder 14 has an inner face 30 with a centrally protruding region 30A thereon adapted to fit and seat within the centrally recessed region 28A of the middle flange portion 12C when the inner face 30 of the terminal holder 14 is placed flush against the inner face 28 of the middle flange portion 12C of the elongated body 12. Also, the terminal holder 14 and the middle flange portion 12C of the elongated body 12 have alignable pairs of holes 32, 34 through the respective outer peripheral edges thereof for receiving fasteners (not shown) to attach or clamp the terminal holder 14 and the middle flange portion 12C of the elongated body 12 to a separate housing (not shown).

More particularly, the terminal holder 14 of the assembly 10 includes an annular base 36 with the inner face 30 on one side thereof and an array of criss-cross walls 38 attached to and projecting from the opposite side of the base 36 and defining a plurality of pockets or cavities 40 in a circumferentially spaced and isolated relationship from one another. Also, a plurality of slots 42 are defined through the base 36 in alignment with the respective cavities 40. When the terminal holder 14 is fitted over the opposite end portion 12B of the elongated body 12 and its annular base 36 is abutted with the annular middle flange portion 12C of the body 12, the cavities 40 and slots 42 of the terminal holder 14 are aligned with the locating passages 26 of the middle flange portion 12C and the locating elements 24 of the one end portion 12A of the elongated body 12.

Referring to FIGS. 1, 6 and 10–12, the assembly 10 also includes first means for interengaging the inner face 28 on the middle flange portion 12C of the elongated body 12 with the inner face 30 on the terminal holder 14 so as to resist and prevent rotation of the terminal holder 14 relative to the elongated body 12 and to provide a predetermined electrical creepage distance between the electrical contact elements 20 at an interface 44 formed between the inner face 30 of the terminal holder 14 and the inner face 28 of the middle flange portion 12C of the body 12. The first interengaging means includes a plurality of first radial ribs or protuberances 46 circumferentially spaced from one another and provided on the inner face 30 of the annular base 36 of the terminal holder 14 and projecting outwardly therefrom, and a plurality of radial slots 48 circumferentially spaced from one another and defined in the inner face 28 of the middle flange portion 12C of the body 12. The first radial protuberances 46 are located between the slots 42 defined through the annular base 36 of the terminal holder 14, while the radial slots 48 are located between the locating passages 26 defined through the middle flange portion 12C of the body 12. The configurations of the radial slots 48 are complementary to the configurations of the first radial protuberances 46, thus adapting the radial slots 48 to respectively receive the first radial protuberances 46 therein.

Figure 7:
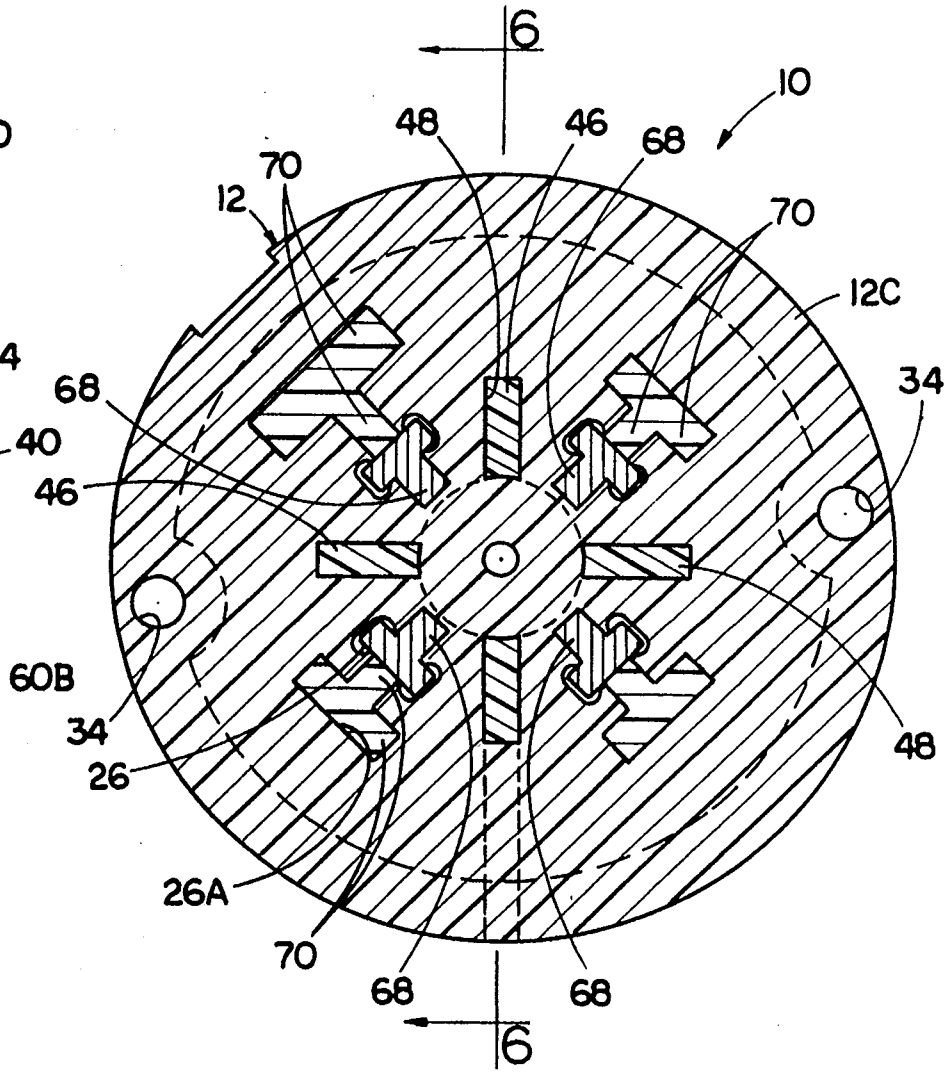
FIG. 7 is a cross-sectional view of the assembly taken along line 7—7 of FIG. 6.
Figure 5:
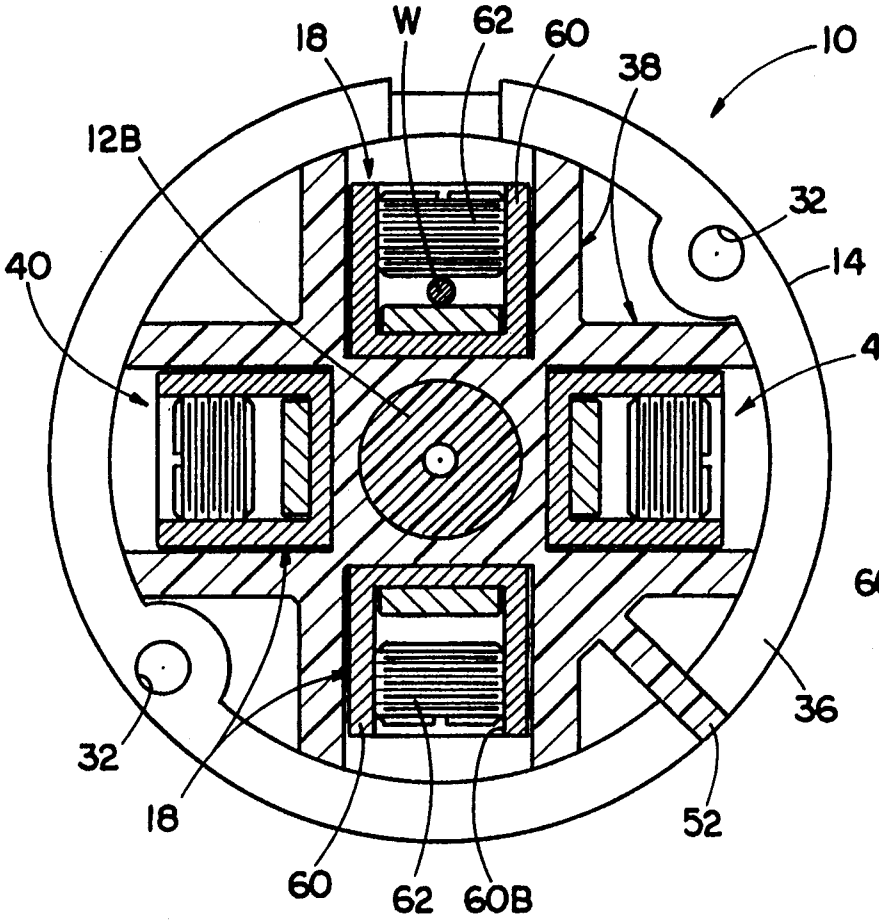
FIG. 5 is a cross-sectional view of the assembly taken along line 5—5 of FIG. 3.
Figure 6:
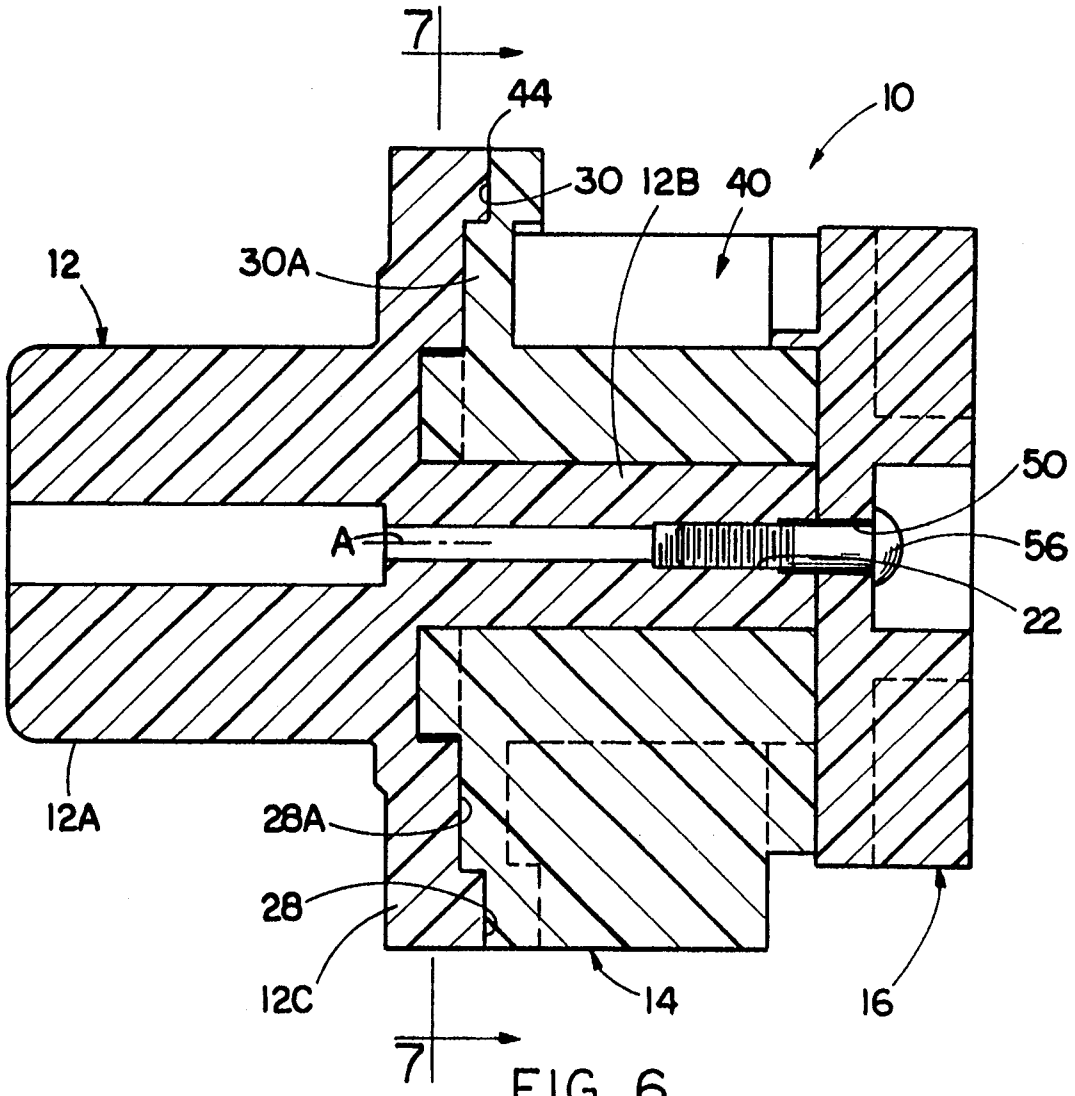
FIG. 6 is a longitudinal sectional view of the assembly taken along line 6—6 of FIG. 7 and along a plane angularly displaced approximately 45° from that of the view of FIG. 3.
Figure 10:
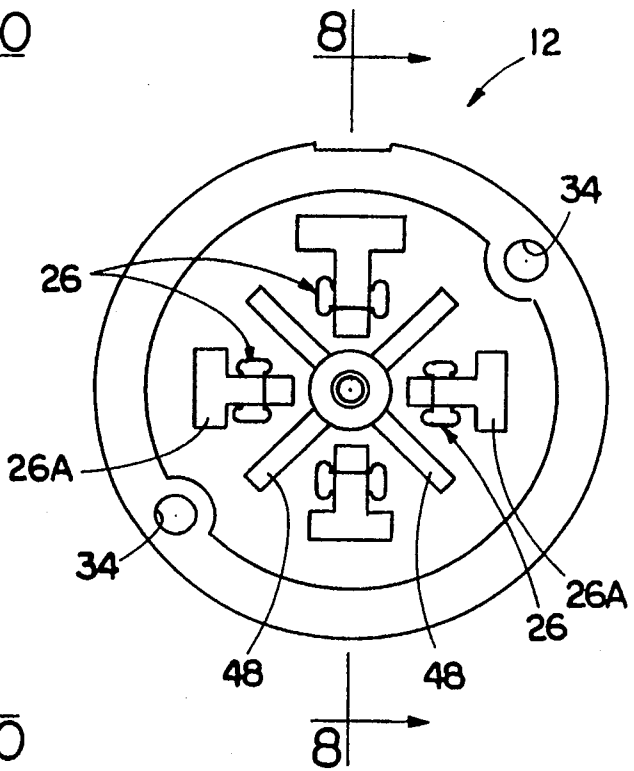
FIG. 10 is an opposite end elevational view of the elongated body as seen along line 10—10 of FIG. 8.
Figure 8:
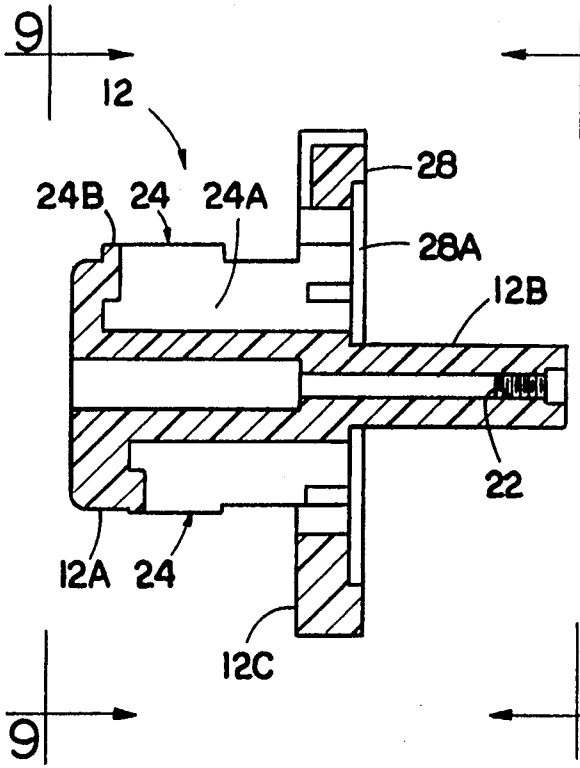
FIG. 8 is a longitudinal sectional view of an elongated body of the assembly taken along line 8—8 of FIG. 10.
Figure 9:
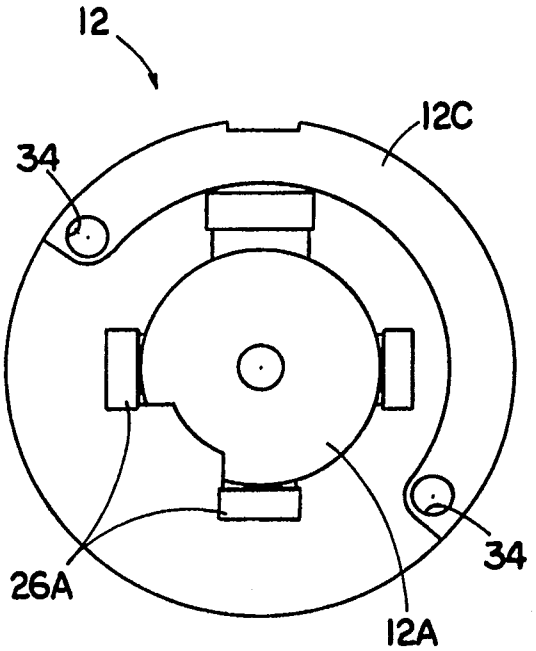
FIG. 9 is one end elevational view of the elongated body as seen along line 9—9 of FIG. 8.
Figure 13:
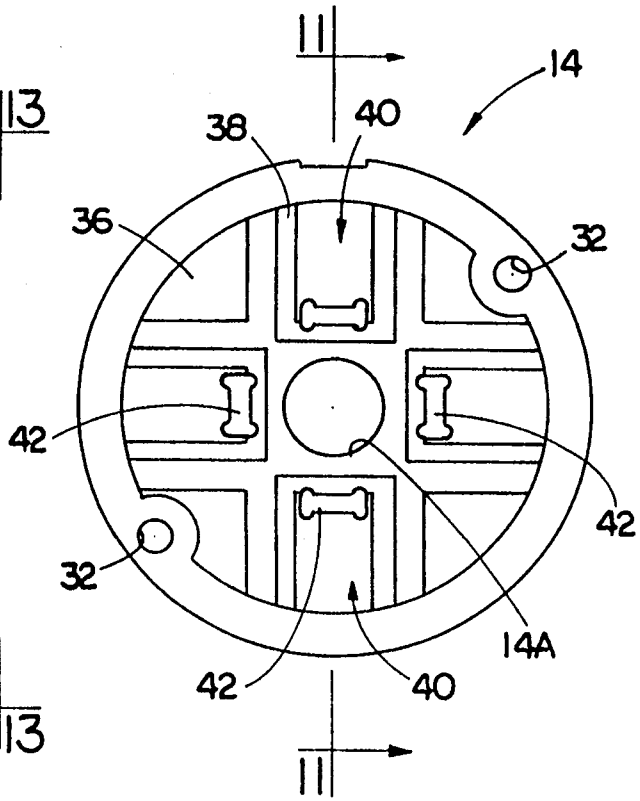
FIG. 13 is an opposite end elevational view of the terminal holder as seen along line 13—13 of FIG. 11.
Figure 11:
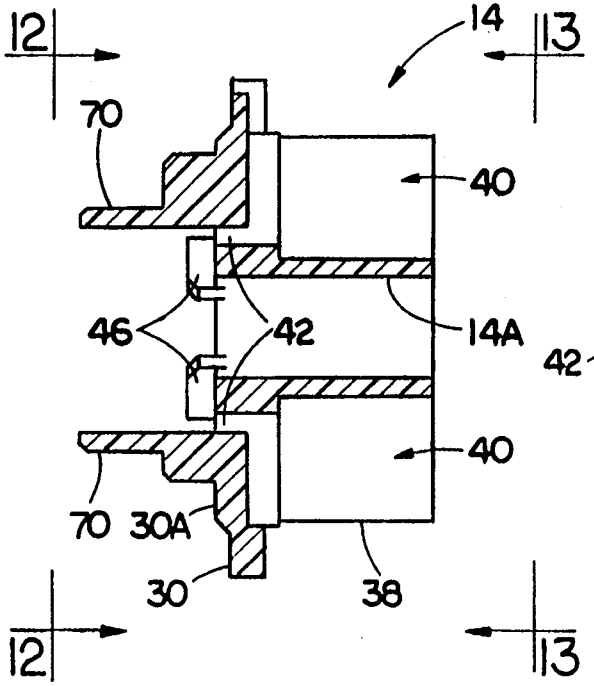
FIG. 11 is a longitudinal sectional view of a terminal holder of the assembly taken along line 11—11 of FIG. 13.
Figure 12:
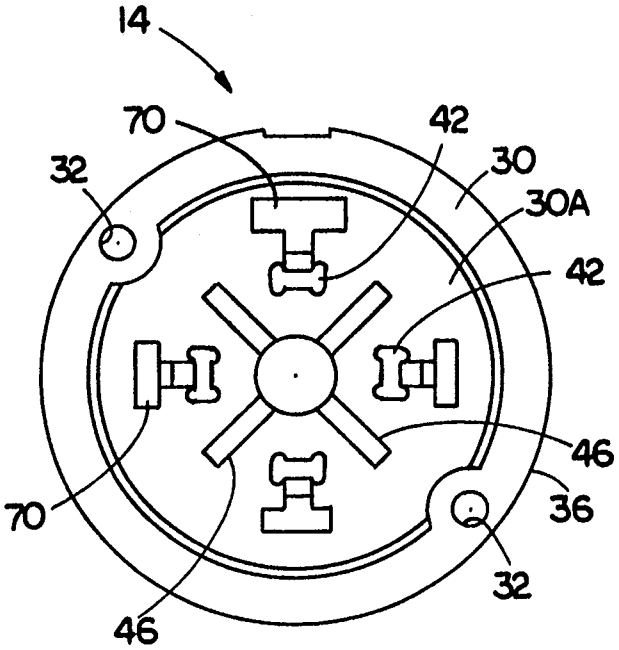
FIG. 12 is one end elevational view of the terminal holder as seen along line 12—12 of FIG. 11.
Figure 16:
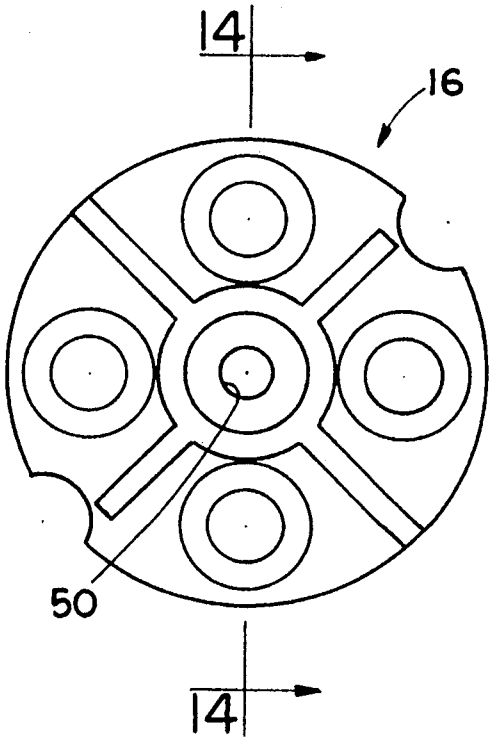
FIG. 16 is an opposite end elevational view of the terminal retainer as seen along line 16—16 of FIG. 14.
Figure 14:
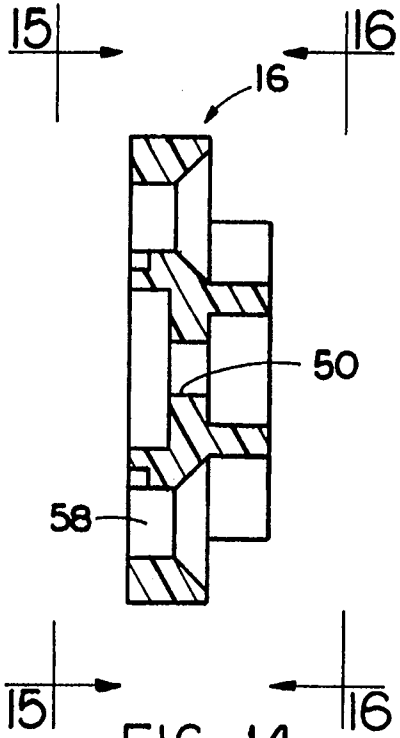
FIG. 14 is a longitudinal sectional view of a terminal retainer of the assembly taken along line 14—14 of FIG. 16.
Figure 15:
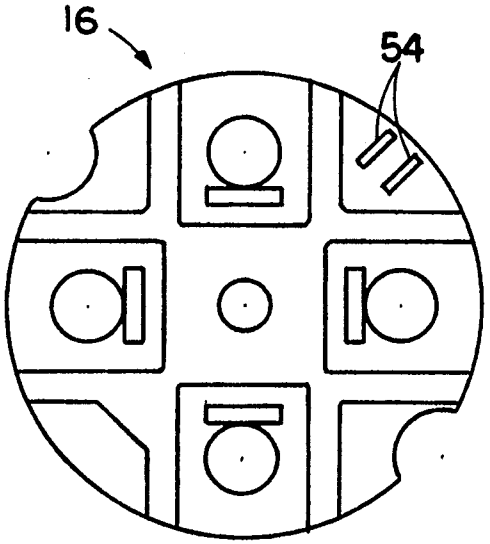
FIG. 15 is one end elevational view of the terminal retainer as seen along line 15—15 of FIG. 14.

Referring to FIGS. 1, 2 and 7, the terminal retainer 16 of the assembly 10 is attachable to the opposite end portion 12B of the elongated body 12 so as to retain or clamp the terminal holder 14 between the terminal retainer 16 and the middle flange portion 12C of the elongated body 12 for retaining the components (body 12, holder 14 and retainer 16) of the assembly 10 as a subassembly for subsequent attachment to a housing (not shown). As described earlier, the opposite end portion 12B of the elongated body 12 has the internally-threaded central opening 22 whereas the terminal retainer 16 has a central aperture 50 being aligned with the threaded central opening 22 when a indexing key 52 (FIG. 13) on the terminal holder 14 is aligned and inserted into a keyway 54 in the terminal retainer 16. As seen in FIGS. 3 and 6, by way of illustration, an externally-threaded fastener 56 is inserted through the central aperture 50 of the terminal retainer 16 and threadably inserted and screwed into the internally-threaded central opening 22 of the elongated body 12 so as to attach the terminal retainer 16 to the elongated body 12 and to retain the terminal holder 14 therebetween in thereby forming the subassembly (assembly 10). As can be appreciated, the components of the subassembly (assembly 10) can be retained together by various other common means rather than by the threaded fastener 56 and internally threaded central opening 22, such a by a press fit fastener.

Referring to FIGS. 1, 3, 14 and 15, the assembly 10 further includes second means for interengaging the terminal holder 14 with the terminal retainer 16 so as to resist rotation of the terminal retainer 16 relative to the terminal holder 14 and to close the open ends of the cavities 40 which contain the electrical terminals 18. The second interengaging means includes the outer end edges 38A of the array of criss-cross walls 38 of the terminal holder 14 and an array of criss-cross channels 58 formed in the side of the terminal retainer 16 facing toward the terminal holder 14. The channels 58 receive therein the outer end edges 38A of the criss-cross walls 38 and in such manner resist rotation of the terminal retainer 16 relative to the terminal holder 14 and close the open ends of the cavities 40 and to provide a predetermined creepage distance.

Referring to FIGS. 1–3 and 5, the electrical terminals 18 are configured to be disposed in the cavities 40 of the terminal holder 14. Each electrical terminal 18 includes a hollow box-like rectangular structure 60 being open at opposite ends 60A to permit insertion of a portion of one of the elongated contact elements 20 therethrough. Also, each terminal structure 60 has an aperture 60B tapped in an outer side and an fastener element 62 is provided being threadably adjustable attached to the hollow rectangular structure 60 within the aperture 60B thereof. The fastener element 62 can be screwed toward and away from the portion of the contact element 20 extending through the terminal structure 60 so as to clamp an end of an electrical conductor wire W between the contact element 20 and the fastener element 62, as seen in FIG. 3.

The elongated electrical contact elements 20 are mounted to the locating elements 24 on the one end portion 12A of the elongated body 12 and extend therefrom through the locating passages 26 of the middle flange portion 12C of the body 12 and through the slots 42 of the terminal holder 14 and through the cavities 40 thereof and through the electrical terminals 18 disposed in the cavities 40 and into the terminal retainer 16 which captures the opposite end of the contact elements 20. Each of the elongated contact elements 20 has a shank portion 64, head portion 66 and neck portion 68. The neck portion 68 extends between and rigidly and integrally interconnects the shank and head portions 64, 66. The neck portion 68 has a transverse width which is smaller than that of both the shank and head portions 64, 66. The head portions 66 of the contact elements 20 are interengaged with the respective locating elements 24 on the one end portion 12A of the elongated body 12. More particularly, the head portion 66 of each contact element 20 has an inner segment 66A and an outer segment 66B being greater in width than the inner segment 66A. The channel 24A of each locating element 24 defined in the one end portion 12A of the body 12 is adapted to receive and seat therein the inner segment 66A of the head portion 66 of one of the contact elements 20 and the flat land 24B defined on the one end portion 12A of the body 12 adjacent to the channel 24A is adapted to receive in overlying relation and to seat thereon the outer segment 66B of the head portion 66 of the one contact element 20. The portion of the neck 68 opposite the head 66 of the elongated contact 20 will rest against the surface 30A of the terminal holder 14, and thus, any forces applied to the elongated contacts 20 will be opposed by the surface 30A on the terminal holder 14. These forces are then transmitted to the outer peripheral edges of the terminal holder 14 and into the separate housing (not shown). Therefore, the function of the fastener 56 is primarily to maintain the components of the assembly 10 together as a subassembly for subsequent insertion into the housing rather than functioning to prevent disassembly of the components should a person accidentally pull on one of the mated connectors to disconnect same without first rotating one of the connectors relative to the other connector from its locked to unlocked position.

Referring to FIGS. 3, 7, 11 and 12, the assembly 10 further includes filling means in the form of a plurality of second tabs or protuberances 70 defined on and projecting outwardly from the inner face 30 of the base 36 of the terminal holder 14 adjacent to the slots 42 therethrough. The second protuberances 70 are adapted to fill portions 26A of the locating passages 26 of the middle flange portion 12C of the elongated body 12 which are provided to permit installation of the head portions 66 of the contact elements 20 through the middle flange portion 12C to the one end portion 12A of the body 12. Thus, these second protuberances 70 are alignable with and extendable through these portions 26A of the locating passages 26. As seen in FIGS. 1 and 7, these portions 26A of the locating passages 26, the second protuberances 70 projecting from the terminal holder 14 and the head portions 66 of the contact elements 20 have substantially identical T-shaped cross-sectional configurations.

Figure 19:
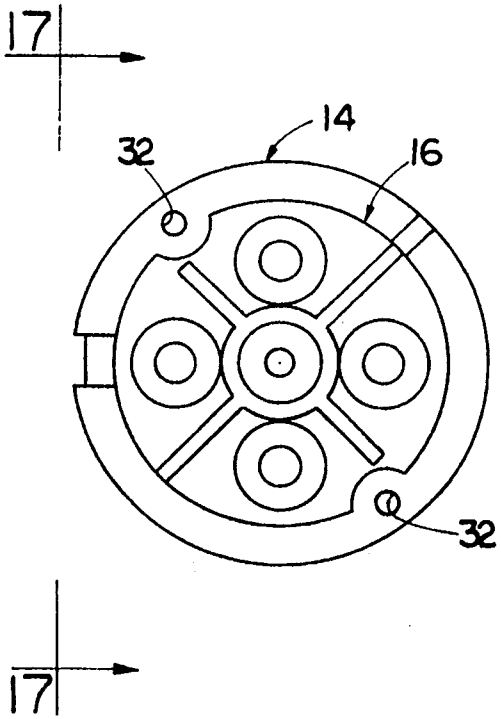
FIG. 19 is an opposite end elevational view of the terminal holder and retainer subassembly as seen along line 19—19 of FIG. 17.
Figure 17:
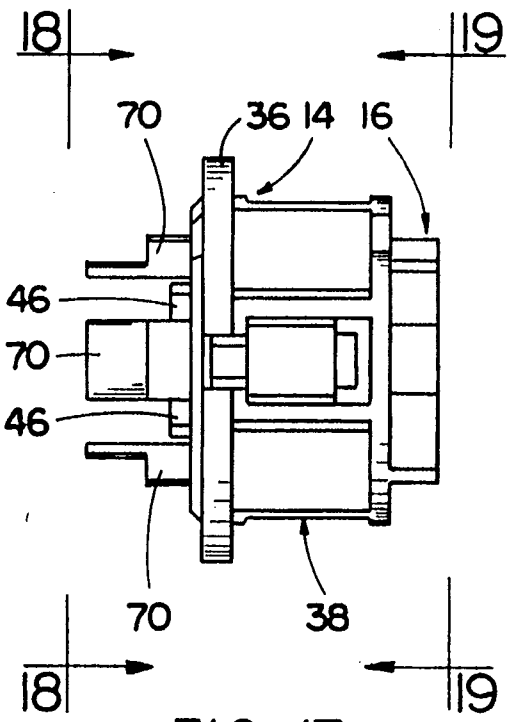
FIG. 17 is a side elevational view of a modified form of the male plug assembly of the present invention wherein the terminal holder and terminal retainer are combined into a one-piece subassembly.
Figure 18:
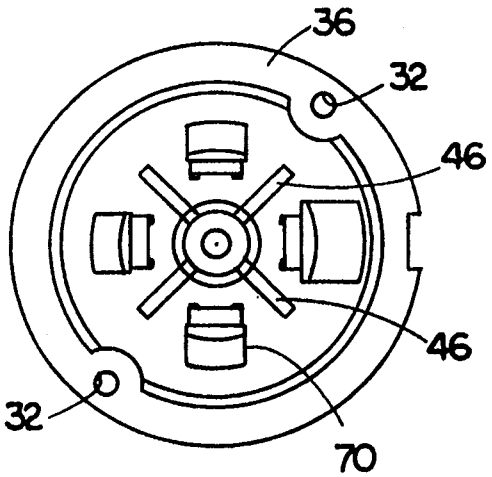
FIG. 18 is one end elevational view of the terminal holder and retainer subassembly as seen along line 18—18 of FIG. 17.

Finally, referring to FIGS. 17–19, there is illustrated a modified form of the terminal holder 14 and terminal retainer 16 of the male plug assembly 10 of the present invention. In this modified form, the only difference is that the terminal holder 14 and terminal retainer 16 are combined or fabricated as a one-piece subassembly.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

We claim:

1. A male electrical plug assembly, comprising:

(a) an elongated body of insulating material including one end portion, an opposite end portion and a middle flange portion integrally connected with and disposed between said one end portion and opposite end portion and extending radially outwardly therefrom, said elongated body having a plurality of locating elements defined on said one end portion of said body being circumferentially spaced and separate from one another and a plurality of locating passages defined through said middle flange portion of said body being aligned with said locating elements;

(b) a terminal holder of insulating material adapted to fit over said opposite end portion of said elongated body and having an inner face adapted to abut against an inner face of said middle flange portion thereof, said terminal holder also having a plurality of cavities formed thereon and a plurality of slots defined therein aligned with said cavities and extending between said cavities and said inner face of said terminal holder, said cavities and slots being alignable with said locating passages of said middle flange portion and said locating elements of said one end portion of said elongated body;

(c) a terminal retainer of insulating material attachable to said opposite end portion of said elongated body so as to retain said terminal holder between said terminal retainer and said middle flange portion of said elongated body;

(d) a plurality of electrical terminals disposed in said cavities of said terminal holder; and (e) a plurality of elongated electrical contact elements mountable to said locating elements on said one end portion of said elongated body and extendable therefrom through said locating passages of said middle flange portion of said elongated body and through said slots and through said cavities of said terminal holder and through said electrical terminals disposed in said cavities of said terminal holder and into said terminal retainer.

2. The assembly as recited in claim 1, wherein said middle flange portion of said elongated body is axially aligned and integrally connected in series with said one end portion and opposite end portion thereof, said middle flange portion being larger in diameter than said opposite end portion and said one end portion of said elongated body, said opposite end portion being smaller in diameter than said one end portion of said elongated body.

3. The assembly as recited in claim 1, wherein:

said opposite end portion of said elongated body has a central opening defined therein; and said terminal retainer has a central aperture defined therein being alignable with said central opening of said opposite end portion of said elongated body.

4. The assembly as recited in claim 3, further comprising:

a fastener adapted to insert through said central aperture of said terminal retainer and inserted into said central opening of said opposite end portion of said elongated body to attach said terminal retainer to said opposite end portion of said elongated body.

5. The assembly as recited in claim 1, further comprising:

first means for interengaging said inner face of said middle flange portion of said elongated body with said inner face of said terminal holder so as to resist rotation of said terminal holder relative to said middle flange portion of said elongated body and to provide a predetermined electrical creepage distance between said electrical contacts at an interface formed between said inner face of said terminal holder and said inner face of said middle flange portion of said elongated body.

6. The assembly as recited in claim 5, wherein said first interengaging means includes:

a plurality of first radial protuberances circumferentially spaced from one another and defined on said inner face of said terminal holder between said plurality of slots defined therethrough; and a plurality of radial slots circumferentially spaced from one another and defined in said inner face of said middle flange portion of said elongated body between said plurality of locating passages defined therethrough, said radial slots being adapted to respectively receive said first radial protuberances of said terminal holder.

7. The assembly as recited in claim 6, wherein said terminal holder has a circular base defined on one end thereof, said first radial protuberances of said terminal holder being formed on said inner face of said circular base and projecting therefrom, said inner face of said circular base being adapted to fit against said inner face of said middle flange of said elongated body with said first radial protuberances thereof extending into said radial slots of said middle flange portion of said elongated body.

8. The assembly as recited in claim 1, further comprising:

second means for interengaging said terminal holder with said terminal retainer so as to resist rotation of said terminal retainer relative to said terminal holder and to provide a predetermined electrical creepage distance.

9. The assembly as recited in claim 1, wherein said terminal holder includes:

a base defined at one end thereof, said base defining said inner face of said terminal holder and having an opposite outer face and said plurality of slots defined therethrough extending between said inner and outer faces; and an array of criss-cross walls attached to and projecting from said outer face of said base and defining said plurality of cavities in a spaced and isolated relationship from one another and being aligned with said slots.

10. The assembly as recited in claim 9, further comprising:

second means for interengaging said terminal holder with said terminal retainer so as to resist rotation of said terminal retainer relative to said terminal holder.

11. The assembly as recited in claim 10, wherein said second interengaging means includes:

outer edges of said array of criss-cross walls of said terminal holder; and an array of criss-cross channels formed in said terminal retainer and receiving therein said outer edges of said array of criss-cross walls on said terminal holder, said outer edges of said array of criss-cross walls of said terminal holder being alignable with and insertable in said array of criss-cross channels of said terminal retainer.

12. The assembly as recited in claim 1, wherein each of said electrical terminals includes:

a hollow rectangular structure being open at opposite ends to permit insertion of a portion of one of said elongated contact elements therethrough; and a fastener element adjustable attached to said hollow rectangular structure so as to undergo movement toward and away from said portion of said contact element to clamp an end of an electrical conductor wire between said contact element and said fastener element.

13. The assembly as recited in claim 1, wherein each of said elongated contact elements has a shank portion, head portion and neck portion, said neck portion extending between and interconnecting said shank and head portions and having a transverse width equal to or smaller than that of said shank and head portions.

14. The assembly as recited in claim 13, wherein said head portions of said contact elements are interengaged with said locating elements on said one end portion of said elongated body.

15. The assembly as recited in claim 14, wherein each of said locating elements includes:

a channel defined in said one end portion of said elongated body adapted to receive and seat therein an inner segment of said head portion of one of said contact elements; and a land defined on said one end portion of said elongated body extending along opposite sides of said channel and adapted to receive in overlying relation and to seat thereon an outer segment of said head portion of one of said contact elements being greater in width than said inner segment of said head portion thereof.

16. The assembly as recited in claim 13, wherein said shank portions of said contact elements extend through said cavities and slots of said terminal holder and through said electrical terminals and into said terminal retainer.

17. The assembly as recited in claim 13, wherein said neck portions of said contact elements extend through said locating passages of said middle flange portion of said elongated body.

18. The assembly as recited in claim 14, further comprising:

means defined on said inner face of said terminal holder adjacent to said slots therein for filling portions of said locating passages of said middle flange portion of said elongated body being provided to permit installation of said head portions of said contact elements through said middle flange portion to said one end portion of said elongated body.

19. The assembly as recited in claim 18, wherein said filling means includes a plurality of second protuberances defined on said inner face of said terminal holder and being alignable with and extendable through said portions of said locating passages defined through said middle flange portion of said elongated body.

20. The assembly as recited in claim 14, wherein said portions of said locating passages through said middle flange portion of said elongated body, said second protuberances on said inner face of said terminal holder and said head portions of said contact elements each have substantially identical T-shaped cross-sectional configurations.

* * * * *